US011274556B2

(12) United States Patent
Pankratov et al.

(10) Patent No.: US 11,274,556 B2
(45) **Date of Patent: *Mar. 15, 2022**

(54) DAMPER GROOVE WITH STRAIN DERIVATIVE AMPLIFYING POCKETS

(71) Applicant: PRATT & WHITNEY CANADA CORP., Longueuil (CA)

(72) Inventors: Maksim Pankratov, Mississauga (CA); Ignatius Theratil, Mississauga (CA); Tony Chang, Toronto (CA); Nicola Houle, Montreal (CA); Vincent Savaria, Laval (CA); Daniel Coutu, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 118 days.

This patent is subject to a terminal disclaimer.

(21) Appl. No.: 16/674,264

(22) Filed: Nov. 5, 2019

(65) Prior Publication Data

US 2020/0072056 A1 Mar. 5, 2020

Related U.S. Application Data

(63) Continuation of application No. 15/278,483, filed on Sep. 28, 2016, now Pat. No. 10,502,061.

(51) Int. Cl.
*F01D 5/10* (2006.01)

(52) U.S. Cl.
CPC ..... *F01D 5/10* (2013.01); *F05D 2220/32* (2013.01); *F05D 2240/24* (2013.01)

(58) Field of Classification Search
CPC ..... F01D 5/00; F01D 5/10
See application file for complete search history.

(56) References Cited

U.S. PATENT DOCUMENTS

| | | | |
|---|---|---|---|
| 4,817,455 | A | 4/1989 | Buxe |
| 4,848,182 | A | 7/1989 | Novotny |
| 5,373,922 | A | 12/1994 | Marra |
| 5,582,077 | A | 12/1996 | Agram |
| 7,217,100 | B2 | 5/2007 | Benderradji et al. |
| 7,458,769 | B2 | 12/2008 | Forgue et al. |
| 8,328,519 | B2 | 12/2012 | Denis et al. |
| 8,747,054 | B2 | 10/2014 | Witlicki |
| 9,151,170 | B2 | 10/2015 | El-Aini et al. |
| 2013/0004313 | A1 | 1/2013 | El-Aini |
| 2014/0314578 | A1 | 10/2014 | Xu |

*Primary Examiner* — Richard A Edgar
*Assistant Examiner* — John S Hunter, Jr.
(74) *Attorney, Agent, or Firm* — Norton Rose Fulbright Canada LLP

(57) ABSTRACT

The stiffness of a rotor part is varied over its circumference to allow damper rings to effectively work in high speed applications. Circumferentially spaced-apart pockets may be defined in the rotor to create discontinuous strain to increase the force required to lock the damper ring in the groove above the centrifugal force of the ring when the rotor is rotating.

8 Claims, 6 Drawing Sheets

DAMPER GROOVE WITH STRAIN DERIVATIVE AMPLIFYING POCKETS

CROSS-REFERENCE TO RELATED APPLICATIONS

This application is a continuation of U.S. patent application Ser. No. 15/278,483, filed Sep. 28, 2016, the entire content of which is incorporated by reference herein.

TECHNICAL FIELD

The application relates generally to gas turbine engines and, more particularly, to a frictional damper arrangement for damping vibrations transmitted to a rotor.

BACKGROUND OF THE ART

Gas turbine engines contain rotating parts (e.g. turbine or compressor rotors, discs, seal runners, etc. . . . ), which are in some cases subject to high vibrations and therefore require mechanical dampers to reduce vibratory stresses to provide adequate field life. Conventional dampers are typically provided in the form of a wire ring installed in a corresponding groove defined in the rotating part. Such ring dampers are subjected to centrifugal loads that create reaction forces between the damper and the mating rotor part. In high speed applications, this force could be enough to stick the damper to the rotor by friction so that no relative sliding is maintained and damper effectiveness is lost because it deforms together with the rotor as one solid body. This phenomenon is referred to as damper lock by friction. When the damper effectiveness is lost, energy dissipation by the damper is significantly reduced resulting in rotor vibratory stress increase that reduces service life and could result in in-flight engine failure.

SUMMARY

In one aspect of an embodiment, there is provided a gas turbine engine rotor comprising: a body mounted for rotation about an axis, a circumferential flange projecting from the body about the axis, a circumferential groove defined in a radially inner surface of the circumferential flange, at least one damper ring mounted in the circumferential groove, a circumferential flange extension projecting from the circumferential flange, and a plurality of circumferentially spaced-apart pockets defined in the circumferential flange extension, the circumferential flange extension and the pockets defining a total volume, the pockets collectively forming about 10% to about 90% of said total volume, the circumferentially spaced-apart pockets providing discontinuous strain around the circumferential groove such that a $P_{lock}/P_{actual}$ ratio is at least equal to 1.0, wherein $P_{lock}$ is a normal force based on the strain between the damper ring and the circumferential groove for a specified coefficient of friction and $P_{actual}$ is a centrifugal force of the damper ring when the rotor is rotating.

In another aspect, there is provided a gas turbine engine rotor comprising: a body mounted for rotation about an axis, a circumferential flange projecting axially from the body about the axis, a circumferential groove defined in a radially inner surface of the circumferential flange, the radially inner surface of the circumferential flange having a radius (R), at least one damper ring mounted in the circumferential groove, a circumferential flange extension depending radially inwardly from the radially inner surface of the circumferential flange, the circumferential flange extension having a radially inner surface having a radius (r), wherein radius (r) is between about 90% to about 97% of radius (R), and a plurality of circumferentially spaced-apart pockets defined in the radially inner surface of the circumferential flange extension, wherein the circumferential flange extension and the pockets define a total volume, and wherein the pockets collectively form about 10% to about 90% of said total volume.

In a further general aspect, there is provided a gas turbine engine rotor comprising: a body mounted for rotation about an axis, a circumferential flange projecting axially from a first face of the body about the axis, the circumferential flange having an axial length (A), a circumferential groove defined in a radially inner surface of the circumferential flange, at least one damper ring mounted in the circumferential groove, a circumferential flange extension projecting axially from the circumferential flange on a second face of the body opposite to the first face thereof, the circumferential flange extension having an axial length (a), wherein the axial length (a) of the circumferential flange extension is between about 30% to about 40% of the axial length (A) of the circumferential flange, and a plurality of circumferentially spaced-apart pockets defined in the circumferential flange extension, wherein the circumferential flange extension and the pockets define a total volume, and wherein the pockets collectively form about 10% to about 90% of said total volume.

In a still further general aspect, there is provided a method of providing frictional damping for a rotor of a gas turbine engine, the rotor having at least one damper ring mounted in a circumferential groove defined in radially inner surface of a circumferential flange projecting from a body of the rotor, the method comprising: locally varying a stiffness of the body around a circumference thereof until a $P_{lock}/P_{actual}$ ratio be at least equal to 1.0, wherein $P_{lock}$ is a normal force based on the strain between the damper ring and the circumferential groove for a specified coefficient of friction and $P_{actual}$ is the centrifugal force of the at least one damper ring when the rotor is rotating.

DESCRIPTION OF THE DRAWINGS

Reference is now made to the accompanying figures in which.

DETAILED DESCRIPTION

Figure 1:
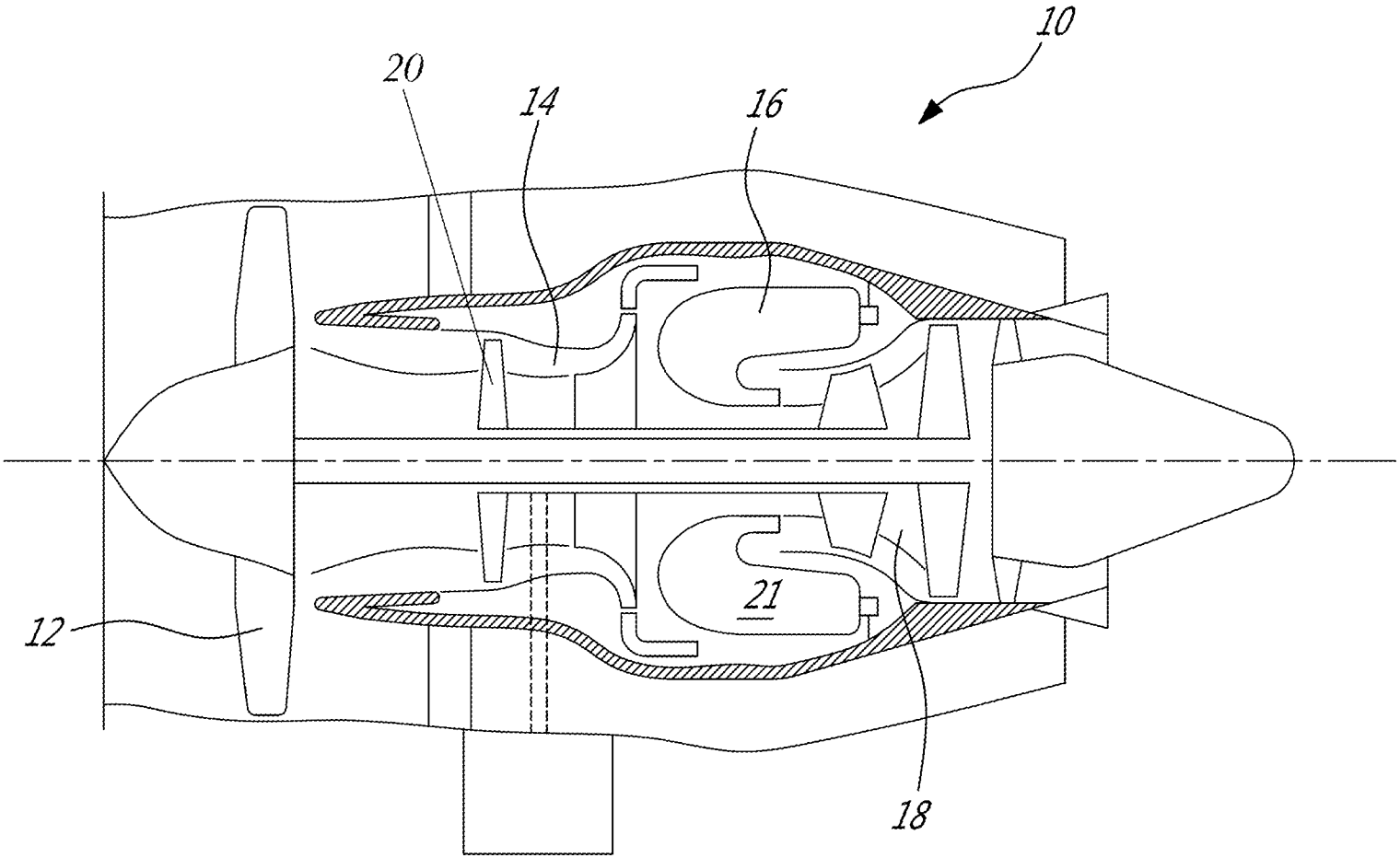
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
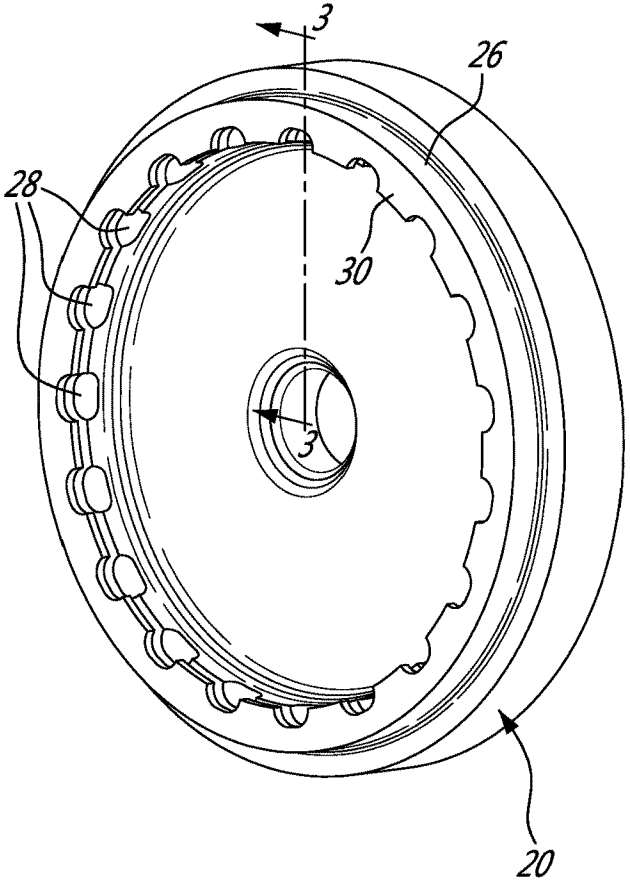
FIG. 2 is an isometric view of a gas turbine engine rotor having radial strain derivative amplifying pockets.

FIG. 2 illustrates a rotary part or rotor 20 of the engine 10. The rotor 20 can take various forms. For instance, the rotor 20 can be a compressor or turbine disk, a seal runner, a turbine cover or any other rotary parts requiring vibration damping.

Figure 4:
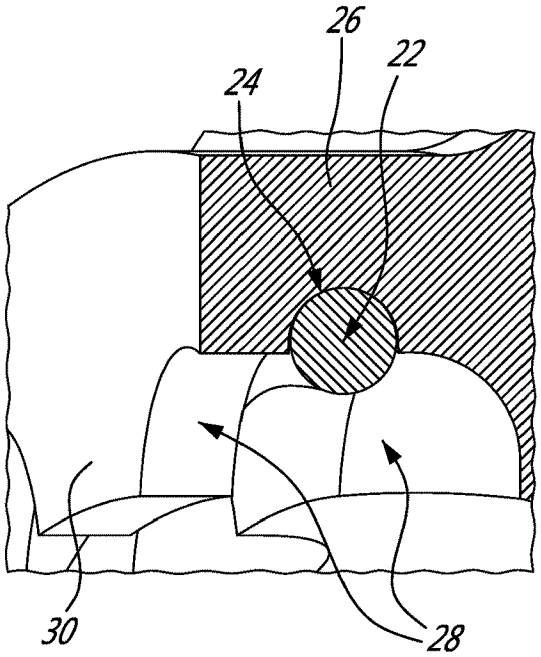
FIG. 4 is an enlarged cross-section view showing a damper ring installed in a circumferential groove defined in the rotor.
Figure 3:
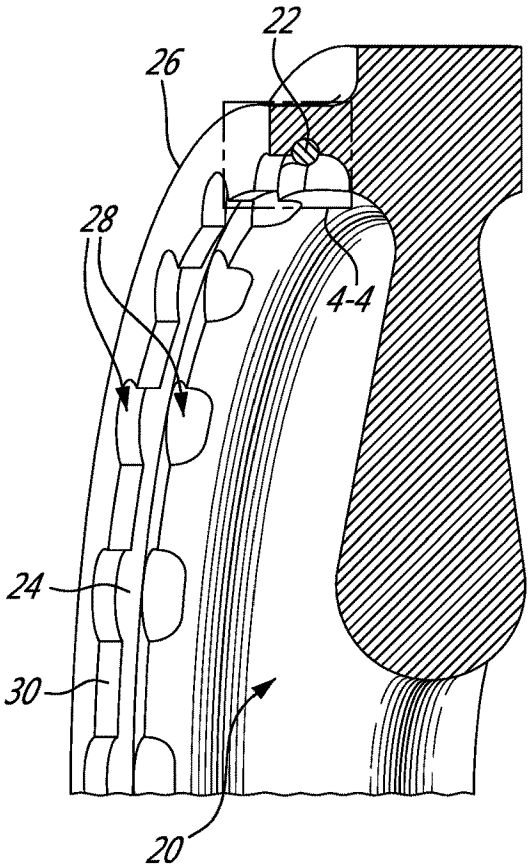
FIG. 3 is a cross-section taken along line A-A in FIG. 2.

As shown in FIGS. 3 and 4, a friction damper, including at least one damper ring 22, may be mounted in an associated circumferential groove 24 defined in a radially inner surface of a circumferential flange 26 projecting axially from one face of the rotor 20. The damper ring 22 may take the form of a conventional wire damper with a round or rectangular cross-section. The damper ring 22 may be split to allow the same to be contracted to a smaller diameter in order to facilitate its installation in the rotor groove 24, as known in the art. Once positioned in the groove 24, the ring 22 springs back towards its relax state against the bottom wall of the groove 24, thereby retaining the ring 22 in place in the absence of centrifugal loading (i.e. when the engine is not running). In use, the centrifugal load firmly urges the damper ring 22 in contact with the radially inwardly facing surface (i.e. the circumferentially extending bottom wall) of the groove 24. Energy is absorbed via sliding friction. The friction generated between the relative motion (i.e. the slippage in the circumferential direction between the damper ring 22 and the rotor 20) of the two surfaces that press against each other under the centrifugal load is used as a source of energy dissipation. However, for the damping system to effectively work, some relative vibratory slippage between the damper ring 22 and the rotor 20 must be maintained even when subjected to high centrifugal loads, such as those encountered when the engine 10 is operating at high regimes. For high speed applications, like in small gas turbine engines, the centrifugal force may become so high that the friction forces tend to lock the damper ring 22 in place in the groove 24, thereby preventing relative vibratory slippage in the circumferential direction between the ring 22 and the rotor 20. Indeed, at high rotation speeds, the friction forces may become so high that the damper ring 22 basically sticks to the rotor 20. When the damper ring 22 sticks in the rotor groove 24, the rotor 20 and the ring 22 becomes like one solid body. In such a case, no more vibration damping is provided. For a damper ring to be effective for any nodal diameter, the ratio $P_{lock}/P_{actual}$ must be at least equal to 1.0, where $P_{lock}$ is the normal force based on the strain between the damper ring 22 and the groove 24 for a given coefficient of friction and $P_{actual}$ is the centrifugal force of the damper ring 22.

Applicant has found that lock by friction phenomenon can be avoided by locally changing the stiffness of the rotor 20 over its circumference. According to the embodiment shown in FIGS. 2 to 4, this is achieved by introducing strain derivative amplifying pockets 28 on either sides of the groove 24 so that the strain distribution at the bottom of the groove 24 becomes wavy over the groove circumference. Such a strain distribution allows to locally increasing the locking force at which the ring 22 becomes locked in the groove 24 above the centrifugal force CF, thereby preserving the ability of the ring 22 to slide in the groove 24.

Figure 10:
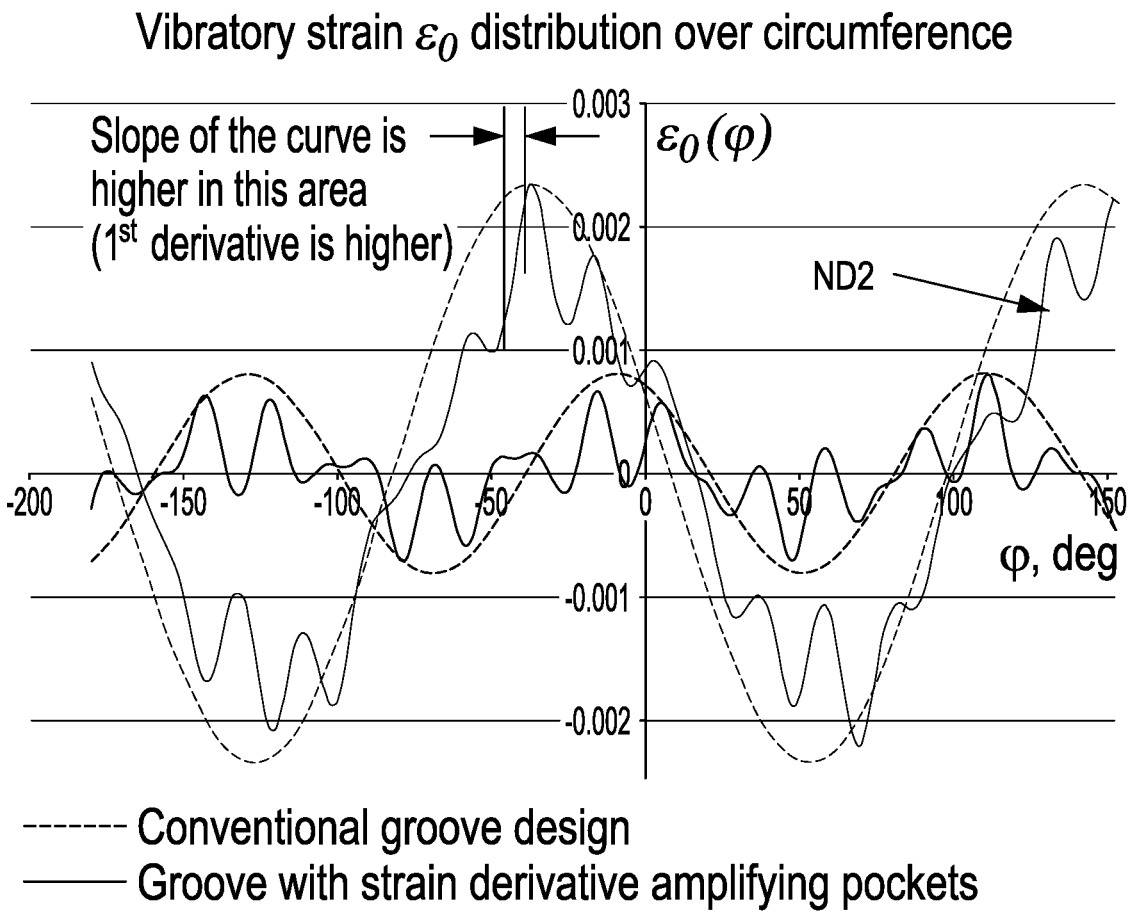
FIG. 10 is a graph showing a vibration strain distribution over a groove circumference for a conventional groove design and a damper groove with strain derivative amplifying pockets.

More particularly, the pockets 28 interrupt circumferential, axial and radial stiffness of the rotor 20 locally near the groove 24 where the damper ring 22 is installed. As a result, local circumferential vibratory strain in the bottom of the groove 24 (where the damper ring contacts the groove) changes rapidly in circumferential direction near the pockets 28 as opposed to conventional groove design where circumferential strain distribution over circumference is smoother and in general for axisymmetric part has a sinusoidal shape (see FIG. 10). The rate of the circumferential strain variation versus angular coordinate can be expressed as a strain derivative versus the angular coordinate. It can be said that the pockets 28 result in increase of the circumferential strain derivative locally in the bottom of the damper groove 24. As a result, the friction force $P_{lock}$ required to lock the damper ring 22 in the groove 24 increases locally above the actual friction force that is calculated as contact force multiplied by friction coefficient. As a result, damper sliding occurs at these high strain derivative locations as opposed to conventional damper groove design, where damper lock would occur on the full circumference.

Figure 5:
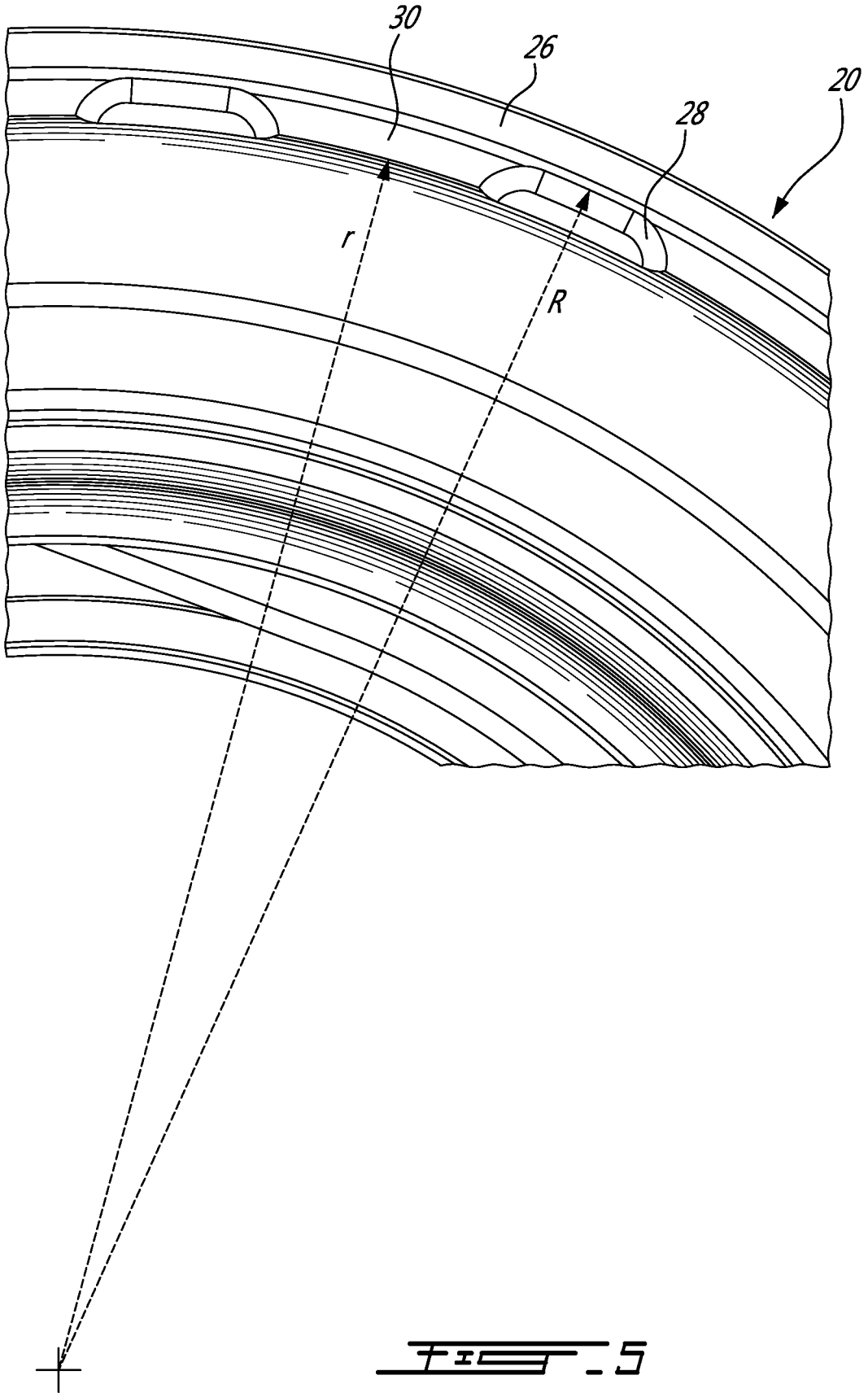
FIG. 5 is a front view of the rotor illustrating a circumferential flange extension depending radially inwardly from a radially inner surface of the flange on which the damper ring is installed.
Figure 7:
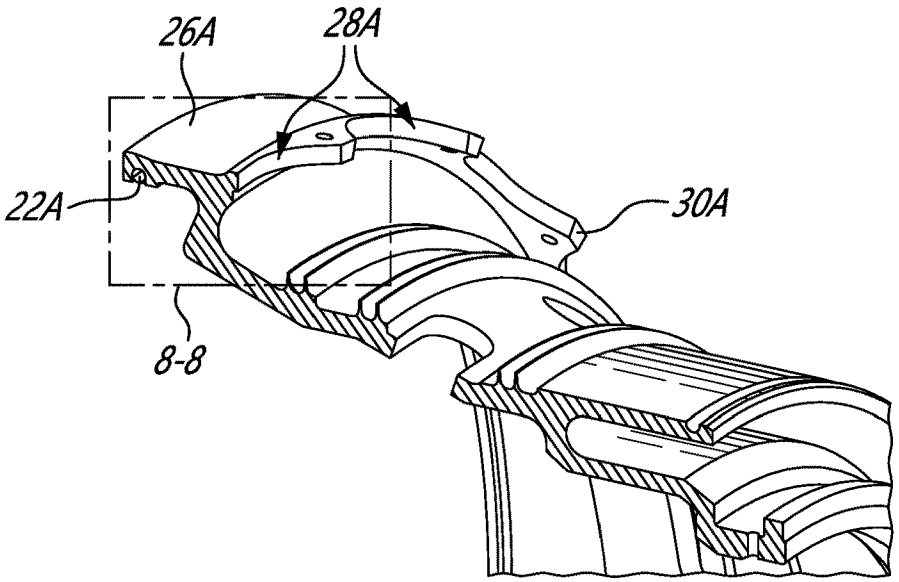
FIG. 7 is a cross-section taken along line B-B in FIG. 6.
Figure 6:
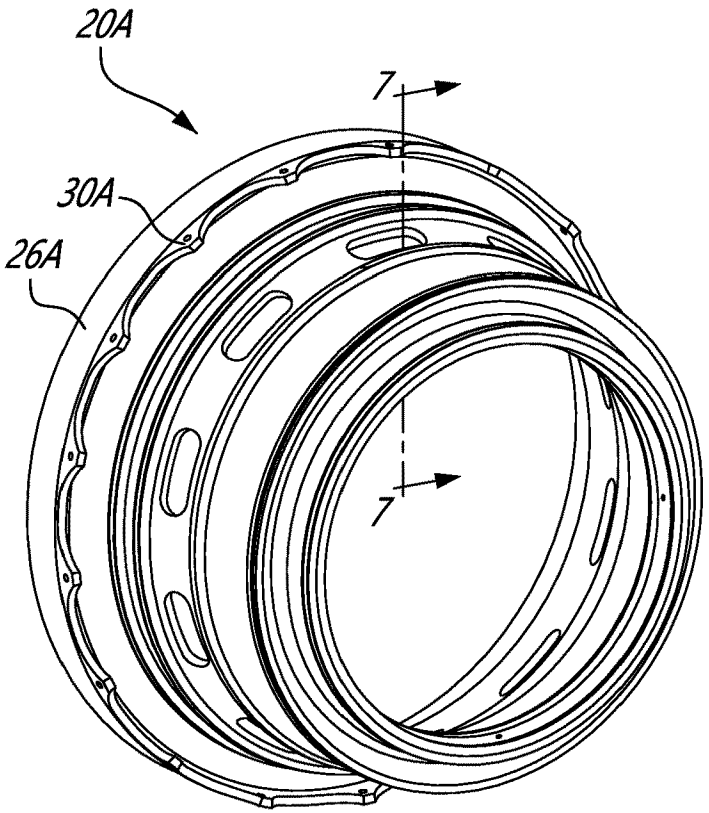
FIG. 6 is a rear isometric view of another rotor having axial strain derivative amplifying pockets.
Figure 8:
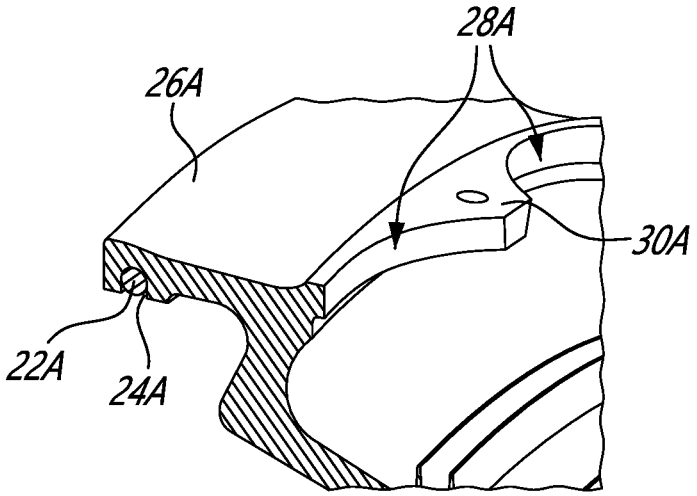
FIG. 8 is an enlarged cross-section view showing a damper ring installed in a circumferential groove defined in a radially inner surface of a flange extending axially from a front face of the rotor.

Accordingly, when $P_{lock}/P_{actual}$ is less than 1.0 for a given design with damper ring configuration, introduction of pockets may be used to create discontinuous strain and thereby increase the ratio $P_{lock}/P_{actual}$ to at least 1.0. In the designed shown in FIGS. 2 to 5, the pockets are introduced by adding a volume of material to the flange 26 and by then removing a portion of said material to form the pockets. According to the embodiment illustrated in FIGS. 2 to 5, the additional volume of material is provided in the form of circumferential flange extension 30 depending radially inwardly from the radially inner surface of the circumferential flange 26 where the damper groove 24 is defined. Applicant has found that the flange extension radius (r) (see FIG. 5) should be between about 90% and about 97% of the radius (R), which is the radius of the grooved flange 26 without the volume of the material added to form pockets 24. In other words, it can be said that the radially inner surface of the flange 26 has a radius (R), the circumferential flange extension 30 has a radially inner surface having a radius (r), and that radius (r) is between about 90% and about 97% of radius (R).

In the embodiment of FIGS. 2 to 5, the pockets 28 are provided in the form uniformly circumferentially spaced-apart radial scallops defined in the radially inner surface of the flange extension 30 on either side of the groove 24. The number of scallops, the depth of scallops, the width of scallops and thickness of scallops are to be defined such that the volume fraction of scallops is between 10% to 90%, wherein the volume fraction of scallops is the ratio of volume of material removed from the flange extension 30 (the initial volume of material added to the flange 26) to form the scallops so that $P_{lock}/P_{actual}$ is at least equal to 1.0. In other words, the pockets 28 collectively form about 10% to about 90% of the total volume between radii (r) and (R) (total volume formed by the pockets and the flange extension). Notably, even more effective results have been achieved with volume fraction of scallops comprised between about 37% to about 85%.

Figure 9:
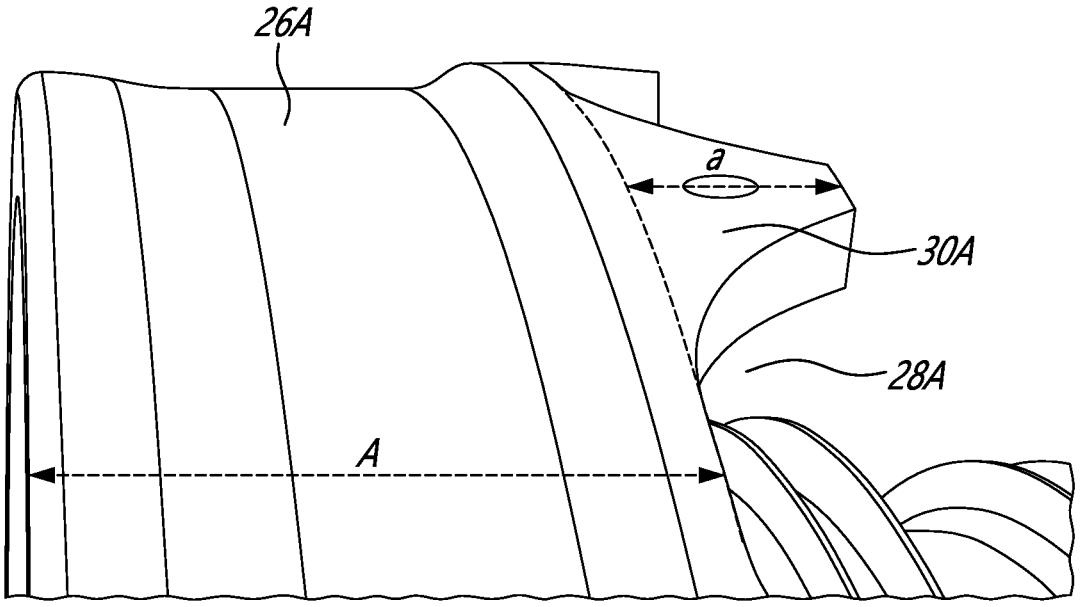
FIG. 9 is an enlarged axial view of the rotor illustrating a flange extension projecting axially rearwardly from the front circumferential flange on which the damper ring is installed.

FIGS. 6 to 9 illustrate another embodiment including a circumferential array of axial pockets 28A instead of radial pockets. The rotor 20A, in this case a seal runner, comprises a circumferential flange 26A projecting axially forwardly from a front face of the rotor body. The damper groove 24A is defined in the radially inner surface of the flange 26A at a forward end thereof for receiving damper ring 22A. The rotor 20A is provided on a back face thereof with a circumferential flange extension 30A projecting axially rearwardly from the flange 26A. As can be seen in FIG. 9, the flange 26A has an axial length (A) and the flange extension 30A (the volume of material added to introduce the axial pockets) has an axial length (a). For a rotor with axial scallops, the axial addition of material (a) on the grooved flange 26A should be between about 30% and about 40% of the axial length (A) (the grooved flange 26A without volume of the material added to from scallops). The volume fraction of scallops shall also be between about 10% and about 90% and, more preferably, between about 37% and about 85%, as mentioned herein above with respect to FIGS. 2 to 5.

Optimal pockets configuration can be achieved, for example, by finite element (FE) contact analysis of a numerical model of a damper ring installed in the rotor groove and subjected to a specified centrifugal load, as for instance described in applicant's application Ser. No. 15/166,588, filed on May 27, 2016, entitled Friction damper, the entire contents of which are herein incorporated by reference. By using computer simulation, each rotor could be specifically designed to allow conventional wire damper to be effectively used in high speed applications by locally increasing $P_{lock}$. An iterative approach can be taken to establish the optimum volume of material to be added to the grooved flange and to determine the number, the dimension, the shape and location of the pockets to be removed from the material added to the grooved flange in order to increase $P_{lock}/P_{actual}$ to at least 1.0. The threshold value line contact pressure [lb/in] required to lock the damper by friction could be calculated by FE transient dynamic analysis (with taking in account friction forces) or analytical method, as known by person skilled in the art and as described in application Ser. No. 15/166,588.

While the radial and axial pockets shown in FIGS. 2 to 9 have a similar scallop shapes, it is understood that the pockets could have different shapes and configuration around the circumference of the flange extension. Also the pockets could have a regular pattern as shown or an irregular pattern to provide added damping efficiency for different wave type vibrations.

The pockets can be precisely machined on a CNC grinder. Alternatively, the flange extension and the pockets could be provided by additive manufacturing. Other suitable manufacturing processes are contemplated as well.

The above description is meant to be exemplary only, and one skilled in the art will recognize that changes may be made to the embodiments described without departing from the scope of the invention disclosed. For instance, the pockets could have an orientation different from the illustrated radial and axial orientation. Other modifications which fall within the scope of the present invention will be apparent to those skilled in the art, in light of a review of this disclosure, and such modifications are intended to fall within the appended claims.

The invention claimed is:

1. A seal runner comprising:

an annular body extending around an axis of rotation, a circumferential flange projecting axially in a cantilevered fashion from a first face of the annular body, the circumferential flange extending around the axis of rotation and having a first axial length along the axis of rotation, a circumferential groove defined in a radially inner surface of the circumferential flange, the circumferential groove disposed at a distal end of the circumferential flange, at least one damper ring mounted in the circumferential groove, a circumferential flange extension projecting axially from the circumferential flange on a second face of the annular body opposite to the first face of the annular body, the circumferential flange extension having a second axial length along the axis of rotation, wherein the second axial length of the circumferential flange extension is between 30% to 40% of the first axial length of the circumferential flange, and circumferentially spaced-apart pockets defined in an axially facing distal edge of the circumferential flange extension remotely from the circumferential groove, the circumferential flange extension and the circumferentially spaced-apart pockets defining a total volume, the circumferentially spaced-apart pockets collectively forming 10% to 90% of said total volume, the circumferentially spaced-apart pockets providing discontinuous strain around a full circumference of the circumferential groove such that a $P_{lock}/P_{actual}$, ratio is at least equal to 1.0, wherein $P_{lock}$ is a normal force based on a strain between the at least one damper ring and the circumferential groove for a specified coefficient of friction and $P_{actual}$ is a centrifugal force of the damper ring when the seal runner is rotating.

2. The seal runner defined in claim 1, wherein the circumferentially spaced-apart pockets are axially spaced-apart from the circumferential groove.

3. The seal runner defined in claim 1, wherein the circumferentially spaced-apart pockets interrupt circumferential, axial, and radial stiffness of the rotor locally next to the circumferential groove.

4. The seal runner defined in claim 1, wherein the circumferentially spaced-apart pockets are defined in a rearwardly axially facing surface of the circumferential flange extension.

5. The seal runner defined in claim 1, wherein the circumferentially spaced-apart pockets collectively form 37% to 85% of said total volume.

6. A gas turbine engine rotor comprising:

a body mounted for rotation about an axis, a circumferential flange projecting axially from a first face of the body about the axis, the circumferential flange having a first axial length, a circumferential groove defined in a radially inner surface of the circumferential flange, at least one damper ring mounted in the circumferential groove, a circumferential flange extension projecting axially from the circumferential flange on a second face of the body opposite to the first face of the body, the circumferential flange extension having a second axial length, wherein the second axial length of the circumferential flange extension is between 30% to 40% of the first axial length of the circumferential flange, and circumferentially spaced-apart pockets defined in the circumferential flange extension and distributed all around the circumferential flange, the circumferentially spaced-apart pockets defined in an axially facing surface of the circumferential flange extension, wherein the circumferential flange extension and the circumferentially spaced-apart pockets define a total volume, and wherein the circumferentially spaced-apart pockets collectively form 10% to 90% of said total volume.

7. The gas turbine engine rotor defined in claim 6, wherein the circumferentially spaced-apart pockets collectively form 37% to 85% of said total volume.

8. The gas turbine engine rotor defined in claim 6, wherein the circumferentially spaced-apart pockets are defined in a rearwardly axially facing surface of the circumferential flange extension.

* * * * *